US006073380A

United States Patent [19]

Hauser et al.

[11] Patent Number: 6,073,380

[45] Date of Patent: Jun. 13, 2000

[54] THREE POSITION SAFETY HAVING TRIGGER AND BOLT ENGAGING POSITIONS FOR A FIREARM

[75] Inventors: Akasius Hauser, Schaffhausen; Roger Meili, Neuhausen am Rheinfall, both of Switzerland

[73] Assignee: SIG Arms International AG, Neuhausen am Rheinfall, Switzerland

[21] Appl. No.: 09/139,758

[22] Filed: Aug. 25, 1998

[30] Foreign Application Priority Data

Aug. 26, 1997 [DE] Germany ..... 197 37 153

[51] Int. Cl.[7] ..... F41A 17/00; F41A 3/00

[52] U.S. Cl. ..... 42/70.06; 42/70.04; 42/70.05; 42/70.08; 42/69.02

[58] Field of Search ..... 42/69.02, 69.01, 42/70.01, 70.04, 70.05, 70.06, 70.08

[56] References Cited

U.S. PATENT DOCUMENTS

| | | | |
|---|---|---|---|
| 2,514,981 | 7/1950 | Walker et al. | 42/69.02 |
| 3,782,022 | 1/1974 | Bielfeldt et al. | 42/70.01 |
| 3,889,574 | 6/1975 | Sanford | 89/169 |
| 4,305,218 | 12/1981 | Godsey | 42/70.08 |
| 4,569,145 | 2/1986 | Ruger et al. | 42/70.06 |
| 4,662,098 | 5/1987 | Timari | 42/69.01 |
| 4,730,406 | 3/1988 | Forbes et al. | 42/70.01 |
| 4,870,770 | 10/1989 | Forbes et al. | 42/70.05 |

FOREIGN PATENT DOCUMENTS

| | | | |
|---|---|---|---|
| 16 78 609 | 2/1971 | Germany . | |
| 322441 | 4/1970 | Sweden | 42/69.02 |

*Primary Examiner*—Michael J. Carone
*Assistant Examiner*—Fredrick T. French, III
*Attorney, Agent, or Firm*—Venable; Gabor J. Kelemen

[57] ABSTRACT

A firearm includes a movable bolt; a striker mechanism including a firing pin; a trigger mechanism including a trigger cooperating with the striker mechanism for releasing the firing pin from a cocked position to fire a shot; a safety lever having a release position, a first locking position and a second locking position; an arrangement for preventing motion of the bolt in the second locking position of the safety lever and for allowing motion of the bolt in the release position and in the first locking position of the safety lever; and an arrangement for preventing a motion of the trigger in the first and second locking positions of the safety lever and for allowing a motion of the trigger in the release position of the safety lever.

14 Claims, 2 Drawing Sheets

THREE POSITION SAFETY HAVING TRIGGER AND BOLT ENGAGING POSITIONS FOR A FIREARM

CROSS-REFERENCE TO RELATED APPLICATION

This application claims the priority of German Patent Application Ser. No. 197 37 153.1, filed Aug. 26, 1997, the subject matter of which is incorporated herein by reference.

BACKGROUND OF THE INVENTION

This invention relates to a safety device for a trigger and a bolt of a firearm, particularly a hunting rifle.

German Offenlegungsschrift (application published without examination) 16 78 609 discloses a trigger for a rifle having a rotary bayonet-type bolt and a safety device. The safety device can be moved from a release position in which firing is possible, to a safety position in which the trigger movement is blocked and the bolt is simultaneously locked. In the known safety the bolt car be unlocked for unloading of the rifle only if the safety element has been shifted to the release position, that is, the weapon safety is released. In such an arrangement a shot can be accidentally fired if the trigger is erroneously pulled before the bolt is opened.

SUMMARY OF THE INVENTION

It is an object of the invention to provide an improved safety mechanism of the above-outlined type which is operationally safe and which may be economically manufactured.

This object and others to become apparent as the specification progresses, are accomplished by the invention, according to which, briefly stated, the firearm includes a movable bolt; a firing mechanism including a firing pin; a trigger mechanism including a trigger cooperating with the firing mechanism for releasing the firing pin from a cocked position to fire a shot; a safety lever having a release position, a first locking position and a second locking position; a mechanism for preventing a motion of the bolt in the second locking position of the safety lever and for allowing motion of the bolt in the release position and in the first locking position of the safety lever; and a mechanism for preventing a motion of the trigger in the first and second locking positions of the safety lever and for allowing a motion of the trigger in the release position of the safety lever.

DETAILED DESCRIPTION OF THE PREFERRED EMBODIMENT

Figures 1, 2:
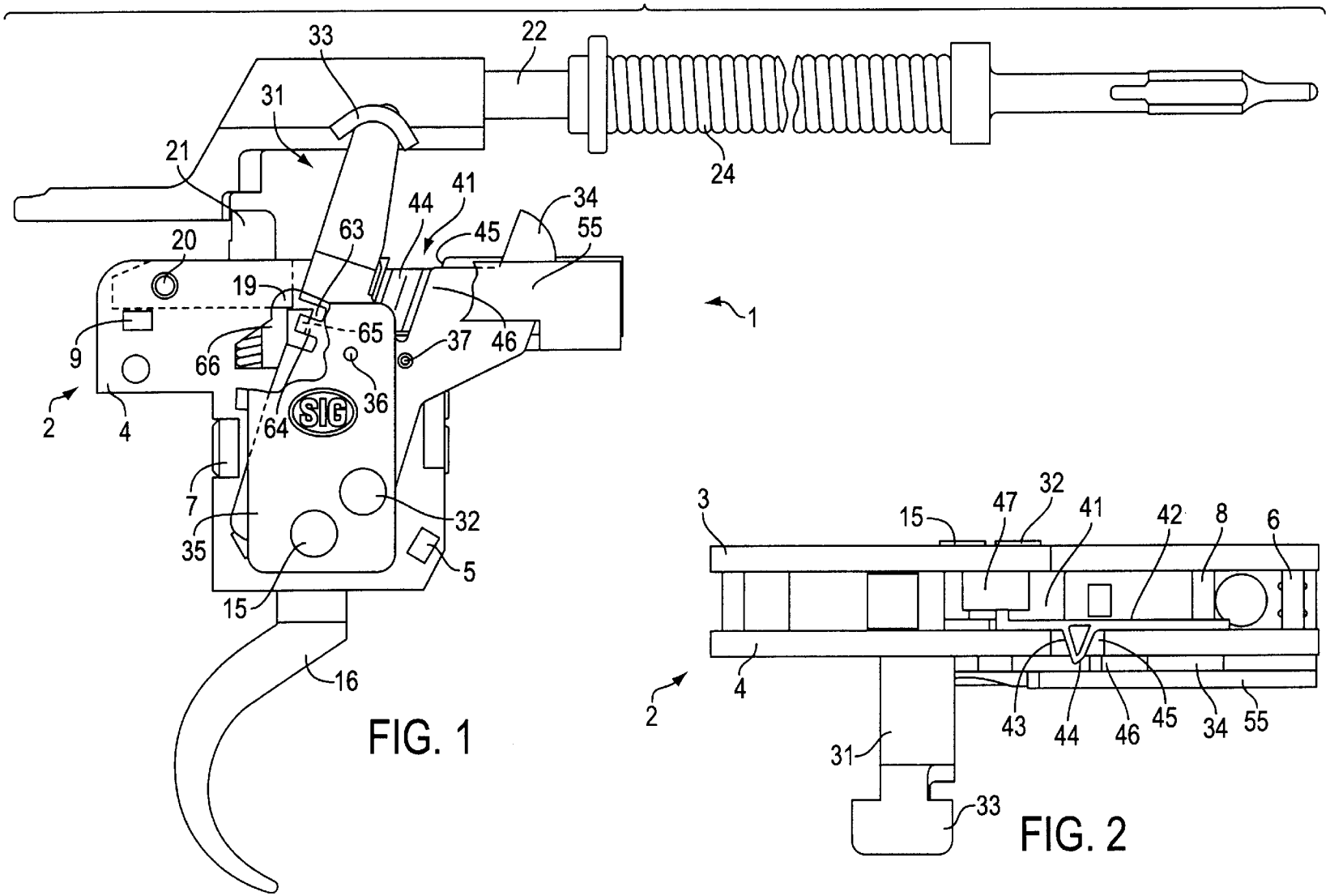
FIG. 1 is a side elevational view of trigger and striker mechanisms according to the invention.
FIG. 2 is a partial top plan view of the structure shown in FIG. 1.

Turning the Figures, the trigger assembly 1 includes a housing 2 formed of two stamped sheet-metal plates 3 and 4 connected to each other with the interposition of spacers 5 to 8. The spacers 5 to 8 have rectangular projections wedged into rectangular throughgoing openings 9 provided in the sheet-metal plates 3 and 4. A two-arm trigger 16 is rotatably supported on a pin 15 inserted into the housing 2. The upper arm 17 of the trigger 16 is rearwardly biased by an adjustable spring 18. In the initial position, the arm 17 abuts a sear 19 from below. The sear 19 is supported in the housing 2 by a pin for pivotal motion thereabout. A lug 21 of the sear 19 holds a spring-loaded firing pin 22 in the cocked position. The sear 19 is urged upwardly by a spring 23. Upon pulling the trigger 16, the arm 17 pivots forward and releases the sear 19. The force of a striker spring 24 causes the sear 19 to pivot downward against the force of spring 23, so that the firing pin 22 is released and the shot is fired.

A further pin 32, carried by the housing 2, pivotally supports a safety lever 31 projecting beyond the housing 2. The safety lever 31 has an angled actuating handle 33 and a catch 34. The pin 15 extends through an arcuate slot which is provided in the safety lever 31 and which limits the forward and rearward pivotal movement thereof. A spring plate 35, into which a detent 36 has been stamped, is riveted in with the pins 15 and 32. The detent 36 may extend into one of three bores 37 in the safety lever 31, whereby the latter may be immobilized by the detent 36 in a rear, center or forward position.

Figure 5:
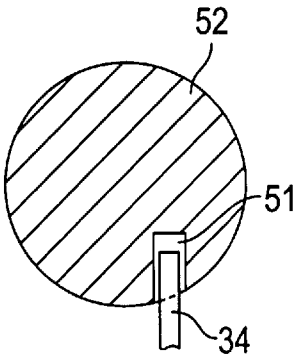
FIG. 5 is a sectional elevational detail of a rotary bayonet-type bolt in a locked state.

The front end of a leaf spring 41 is attached to the inside of sheet-metal plate 4 by means of the spacer 8. The leaf spring 41 is composed of two spring components 42, 43 welded together by projection-welding. While the spring component 42 is planar, the spring component 43 has a projection 44 which is formed by a U-shaped bend and which extends through an opening 45 in the sheet metal plate 4 and projects beyond the outer face of the sheet metal plate 4 when safety lever 31 is in the frontal position. When the safety lever 31 is in the center or rear detent position, a lug 46 of the safety lever 31 depresses the projection 44, so that the rearward, free end of the leaf spring 41 is pivoted out to the side and comes to rest against a limit stop 47 of the housing 2. In this position the from surface 49 of leaf spring 41 is pushed in front of a limit stop surface 50 of the trigger 16, thereby blocking (securing) the trigger 16. The limit stop 47 increases the buckling strength of the leaf spring 41. As shown in FIG. 5, in the rear detent position the catch 34 engages into a corresponding groove 51 of the bayonet-type rotary bolt 52 of the hunting rifle. As a result, the bolt 52 is also locked and thus cannot be opened. In the center detent position of the safety lever 31 the trigger assembly 1 is secured, but the bolt 52 can be opened for unloading.

As shown in FIGS. 1 and 2, to absorb rotational moments during the attempt to actuate the bolt 52, a guide plate 55 is attached to the casing 2, which laterally bounds the catch 34 on the outside of the housing plate 4. The guide plate is shown shortened in FIG. 1 to render the lug 46 visible.

Figure 4:
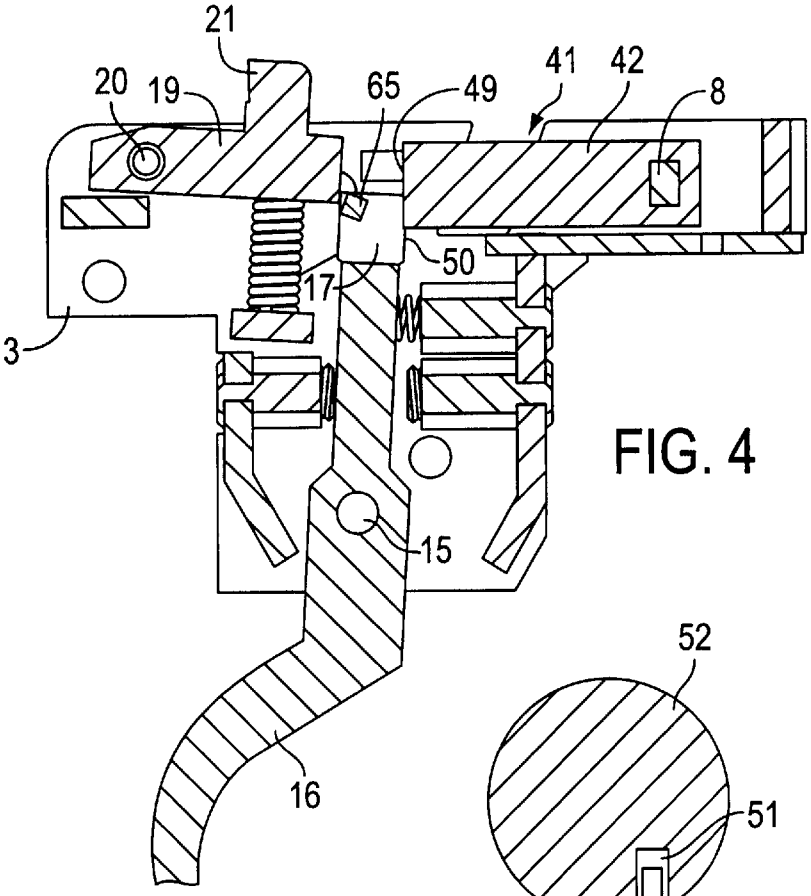
FIGS. 3 and 4 are sectional side elevational views of the structure shown in FIG. 1, illustrating two operational positions.

As also shown in FIG. 1, the safety lever 31 has two stamped-out slots 63 between which thus a strip 64 is formed, whose free end is bent inwardly at a right angle and forms a locking element 65, which projects through an opening 66 in plate 4 beyond the inner face thereof. Also referring to FIG. 4, after a shot has been fired and the sear 19 pivots downward (releasing thereby the firing pin 22), the locking element 65 is blocked by the sear 19 and the safety lever 31 is thus prevented from pivoting rearwardly, out of its release position. This arrangement avoids unnecessary errors in the handling and increases the safety. If the bolt is cocked, the sear 19 is in the upper position, as shown in FIG. 3, whereby such a blocking is ineffective and the safety lever thus may be moved into its middle and/or rear locking positions.

Figure 3:
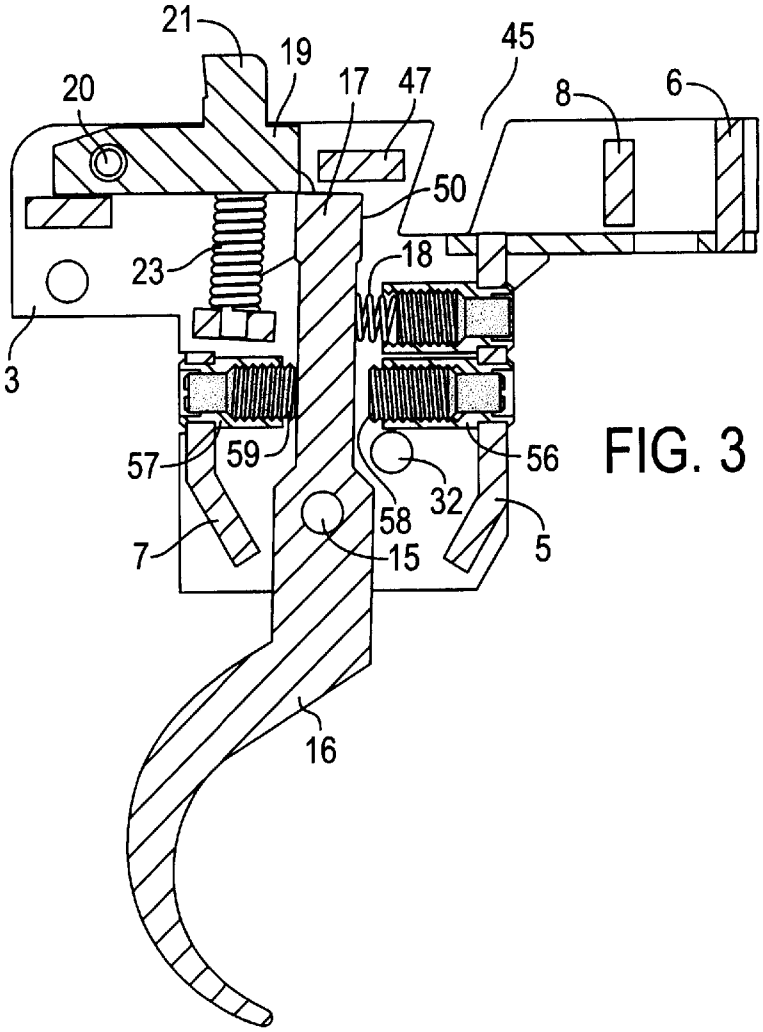

As further illustrated in FIG. 3, the housing 2 threadedly supports within two bushings 56 and 57 two set screws 58 and 59 adjustably determining opposite ends of the travel path 59 of the trigger arm 17 to thus vary the extent of pivotal motion of the trigger 16.

It will be understood that the above description of the present invention is susceptible to various modifications, changes and adaptations, and the same are intended to be comprehended within the meaning and range of equivalents of the appended claims.

What is claimed is:

1. A firearm comprising (a) a housing;

(b) a movable bolt;

(c) a striker mechanism including a firing pin;

(d) a trigger mechanism including a two-armed trigger pivotally supported by said housing; one of the arms of said trigger cooperating with said striker mechanism for releasing said firing pin from a cocked position to fire a shot;

(e) a safety lever pivotally supported by said housing and having a release position, a first locking position and a second locking position; in said release position and in said first locking position said safety lever being withdrawn from said bolt, whereby said bolt is in a released state and in said second locking position said safety lever preventing a motion of said bolt, whereby said bolt is in a blocked state; and (f) a leaf spring having an end secured to said housing; said leaf spring including a movable portion having a blocking position in which said movable portion is situated in a path of travel of said arm, whereby motion of said trigger is blocked; said movable portion of said leaf spring having an unblocking position in which said movable portion is situated externally of said path of travel of said arm for allowing motion of said trigger; said safety lever cooperating with said movable portion of said leaf spring such that said movable portion of said leaf spring is placed into said blocking position from said unblocking position by said safety lever upon motion of said safety lever from said release position into either of said first and second locking positions thereof.

2. The firearm as defined in claim 1, wherein said release position, said first locking position and said second locking position of said safety lever constitutes, respectively, a forward position, a middle position and a rearward position of said safety lever.

3. The firearm as defined in claim 1, further comprising an adjustable spring engaging said arm for biasing said trigger.

4. The firearm as defined in claim 1, further comprising two screws threadedly held in said housing for adjustably limiting a travel path of said trigger.

5. The firearm as defined in claim 1, further comprising a stop secured to said housing; further wherein an end of said movable portion of said leaf spring abuts said stop in said first and second locking positions of said safety lever.

6. The firearm as defined in claim 1, further comprising a catch affixed to said safety lever and a groove provided in said bolt; said catch extending into said groove solely in said second locking position of said safety lever for preventing motion of said bolt.

7. The firearm as defined in claim 6, further comprising a guide plate secured to said housing and laterally bounding said catch.

8. The firearm as defined in claim 1, wherein said housing is composed of two sheet-metal plates connected to one another by spacers.

9. The firearm as defined in claim 8, wherein said plates have apertures accommodating wedged ends of said spacers.

10. The firearm as defined in claim 1, further wherein said trigger mechanism includes a sear having a cocked position holding said striker mechanism and a releasing position; in said releasing position said sear preventing said safety lever from moving out of said release position thereof.

11. The firearm as defined in claim 10, further wherein said safety lever has a locking element moving with said safety lever as a unit; said sear blocking said locking element in said releasing position of said sear.

12. The firearm as defined in claim 1, further comprising a lug affixed to said safety lever and a projection provided on said leaf spring; said lug depressing said leaf spring at said projection for displacing said movable portion of said leaf spring into said blocking position in said first and second locking positions of said safety lever.

13. The firearm as defined in claim 12, wherein said leaf spring is composed of two spring parts and one of said spring parts has a U-shaped bend constituting said projection.

14. The firearm as defined in claim 13, wherein said two spring parts are bonded to one another by a weld.

* * * * *